United States Patent [19]

Bradley

[11] Patent Number: 4,762,031

[45] Date of Patent: Aug. 9, 1988

[54] RATCHET WRENCHES

[76] Inventor: Ross Bradley, R.R. #1, Box 260, New Buffalo, Mich. 49117

[21] Appl. No.: 904,559

[22] Filed: Sep. 5, 1986

[51] Int. Cl.[4] ..... B25B 23/00; B25B 17/00

[52] U.S. Cl. ..... 81/57.22; 81/57.26; 81/57.29; 81/180.1

[58] Field of Search ..... 81/57.29, 57.32, 57.22, 81/57.26, 57.27, 57.28, 58.1, 58.3, 57.12, 57.13, 57.39, 57.45, 180.1, 185.2, 73, 74, 75; 74/417, 423, 34, 35

[56] References Cited

U.S. PATENT DOCUMENTS

| | | | |
|---|---|---|---|
| 1,659,838 | 2/1928 | Schoeb | 81/57.26 |
| 2,703,030 | 3/1955 | Marvin | 81/58.1 |
| 4,086,829 | 5/1978 | Hudgins | 81/57.29 |
| 4,128,025 | 12/1978 | Main | 81/57.29 |
| 4,515,043 | 5/1985 | Gray | 81/57.29 |

FOREIGN PATENT DOCUMENTS

| | | | |
|---|---|---|---|
| 389555 | 11/1973 | U.S.S.R. | 81/57.13 |

*Primary Examiner*—Frederick R. Schmidt
*Assistant Examiner*—Bradley I. Vaught
*Attorney, Agent, or Firm*—Richard G. Kinney

[57] ABSTRACT

Improvements for ratchet wrenches which allows the socket to be turned without pivoting the handle. The improvements include a flat gear which either fits over the drive stud of the wrench's head and is sandwiched in between the head and a socket snapped on the head or is made integrally with the head. The gear projects beyond the socket and has driven gear teeth about its periphery. This allows for easy hand-turning. A shaft which has a means for turning at one end and a drive gear at the head end is provided. The shaft is mounted for both rotational and axial displacement and may slide from a home position in which the drive gear is free of the the flat gear to a position in which it meshes with that gear. A spring mechanically biases the shaft to its home position. A user may easily push the shaft to its operational position and, while maintaining it there, turn the shaft to turn the flat gear and thus the stud and socket. Upon releasing, the shaft automatically returns to its home position. In one embodiment the shaft is mounted to an elongated base so that the handle of the wrench can be moved independently of the shaft and base.

10 Claims, 4 Drawing Sheets

RATCHET WRENCHES

FIELD OF THE INVENTION

This invention relates to improvements in ratchet or socket wrenches and is especially concerned with improvements which allow the socket to be easily and quickly turned under little or no resistance situations, particularly in difficult or hard-to-reach areas.

BACKGROUND OF THE INVENTION

Socket ratchet wrenches are extremely useful tools which have become almost universally used by professional as well as amateur mechanics, especially automobile and truck mechanics. Such conventional tools do have a drawback in starting a nut onto a threaded shaft or a short bolt into a threaded hole. Normally, the nut or bolt must be tightened sufficiently to provide back pressure to the ratchet, or else the ratchet won't operate. That is, when rotated backward (counter to the tightening direction, say, counterclockwise), the loose nut or bolt just travels (counterclockwise) with the socket, and a return (clockwise) of the wrench just puts the nut back where it started.

One prior art solution is to hand-spin the nut on the threaded shaft until it is finger-tight. Or to hand-turn the socket (the cylindrical replaceable element that receives the nut and fits into the square ratchet projection) to the same end. Lately, a thin "turner" device or disc has been provided. This is sandwiched between the socket and the ratchet wrench and is of such a diameter that it sticks out beyond the sides of the socket. Its knurled edge or rim is more easily hand-turned than is the smooth socket.

It has also been suggested to make special wrenches which drive the drive stud (which receives the socket) from inside the handle. See, e.g., U. S. Pat. Nos. 3,707,893; 4,258,594; 4,406,183; 4,406,184; 4,532,832 and 4,453,437. Or to provide an additional gear wrench to be used with the ratchet wrench to drive a socket as in U.S. Pat. No. 4,242,931.

Such prior approaches are expensive to make and tend to limit the usefulness of the primary socket wrench. They are often inconvenient to use since they require special set-up procedures and extra removal steps needed, e.g., to switch from driving the socket without pivoting the handle to the conventional mode of use.

SUMMARY OF THE INVENTION

The present invention, in overcoming one or more of the drawbacks which heretofore existed, provides an improvement to a socket wrench which is economical to make and effective and easy to use.

A device for retrofitting on a standard ratchet wrench and constructed in accordance with a main feature of the invention includes an elongated base. A flat gear member is mounted for free rotation at one end of the base. The flat gear member has a central opening sized and shaped to fit over the drive stud of the wrench. The member has a flat thin area about the stud so that a socket may be received on the stud with the flat gear sandwiched between the socket and the head of the wrench. Outside of that area and projecting out from the socket, the gear member has a periphery of gear teeth. A drive shaft assembly is mounted on a long base from its handle end to the flat member. The shaft has a drive gear at its head end and means for rotating the shaft and that drive gear at its handle and is mounted for slidable movement between a home position and an engaged position. In the home position, the drive gear is free of the flat gear member, but in the operational position, the drive gear engages the teeth of the flat gear member so as to be able to turn it in response to rotation of the shaft, so that the stud and socket may be turned without moving the wrench handle.

In accordance with a second major feature of the invention, a wrench is constructed with a slidable drive shaft assembly mechanically biased, e.g., by a spring, to the home position so as to automatically return there when manually released. This allows it to be used and, by the simple removal of the hand from the turning means, the shaft assembly moves out of the way so that the wrench can then be used in the normal way.

Other features of the invention will be apparent from the following description and the claims.

The invention, together with the advantages thereof, may best be understood by reference to the following description taken in connection with the accompanying drawings, in the several figures of which, like reference numerals identify like elements.

DETAILED DESCRIPTION

Figure 1:
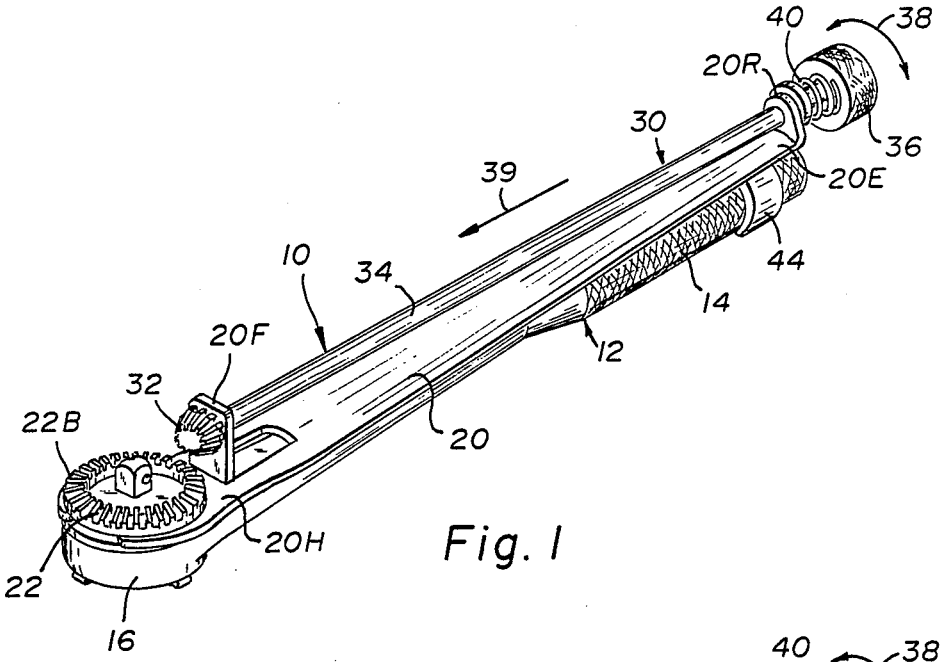
FIG. 1 is a perspective view of a retrofitting device constructed in accordance with the principles of the present invention attached to a conventional ratchet wrench.

Referring to FIGS. 1–8 and especially to FIG. 1, there is depicted a retrofit device constructed in accordance with the principles of the present invention and generally designated by the number 10. The device 10 is shown mounted on and fitted to a conventional ratchet socket wrench 12.

Figure 2:
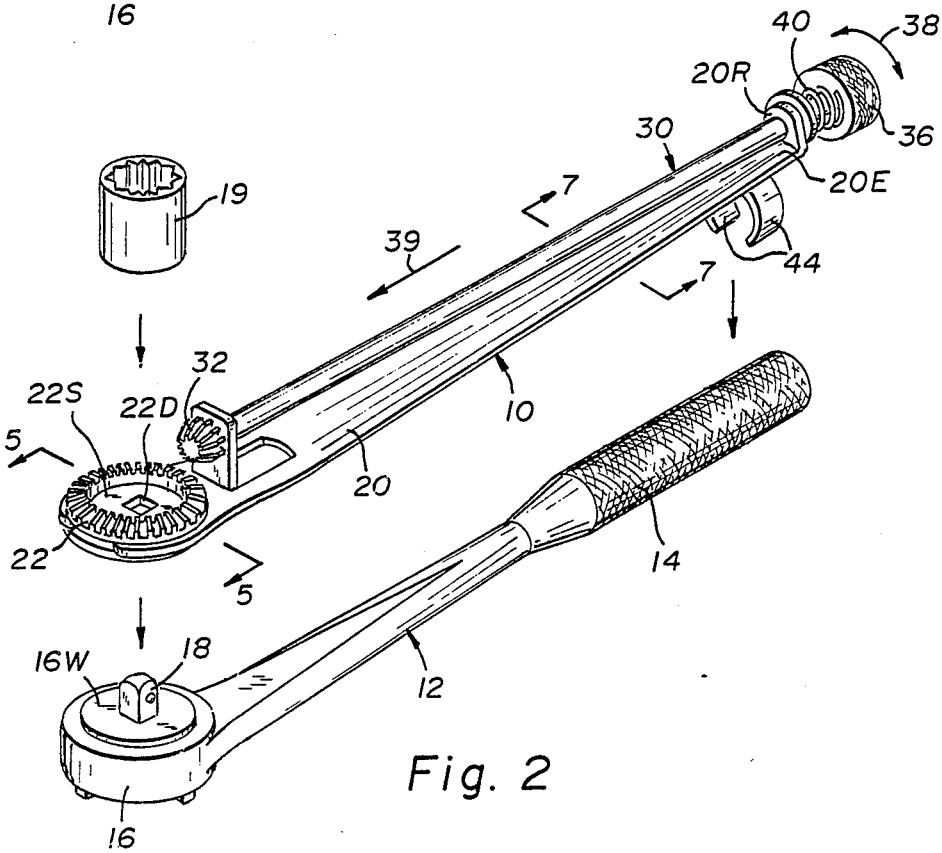
FIG. 2 is a perspective view of the device of FIG. 1 and the wrench of FIG. 1 separated - illustrating the method of attachment.

As better shown in FIG. 2, the conventional wrench 12 includes a handle portion 14 and a head portion 16. The head 16 has a flat portion l6W (which is sometimes called a drive wheel), from which projects a drive stud 18. This stud 18 receives sockets of various types, such as the socket 19, and has a detent for releasably holding such sockets.

Figure 5:
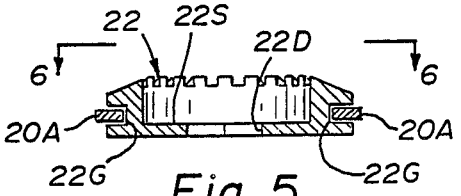
FIG. 5 is a sectional view of the device of FIGS. 1–4 as seen from the plane indicated by the line 5—5 of FIG. 2 when looking in the direction of the arrows in that view.
Figure 6:
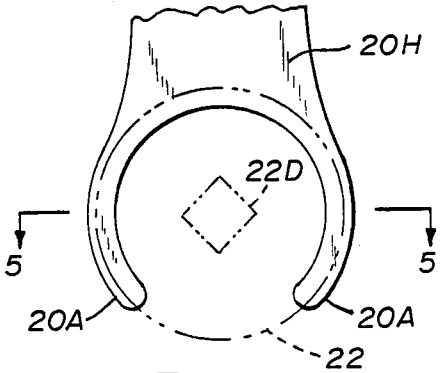
FIG. 6 is a partial top view of the device as seen from the plane indicated by the line 6—6 in FIG. 5 when looking in the direction of the arrows, with one part shown by dashed outline.

The device 10 has an elongated base 20 with a head end 20H and handle end 20E. Mounted at the head end 20H is a flat gear member 22. As best shown in FIGS. 5 and 6, the head end 20H of the base 20 holds the flat gear member 22 in a pair of arms 20A which are loosely received in a circular groove 22G about the periphery of the member 22. The fit between the arms 20A and the groove 22G is loose so that the member 22 may freely turn relative to the base 20.

Figure 3:
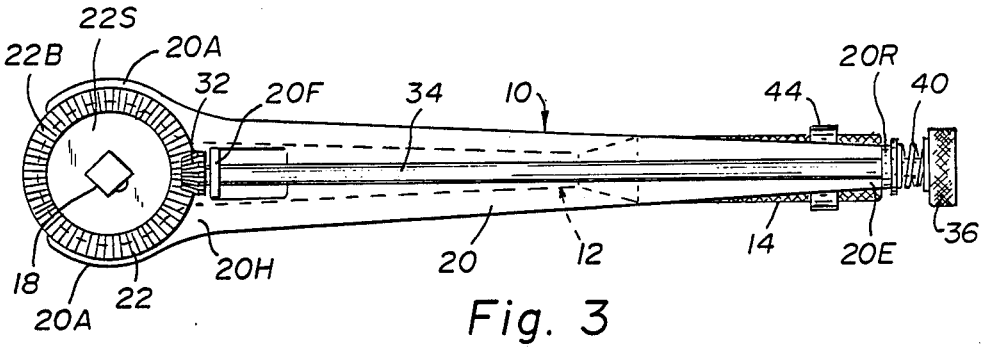
FIG. 3 is a top view of the wrench and device of FIGS. 1 and 2, assembled in FIG. 1, with the outline of the handle of the wrench shown in part by dashed lines.
Figure 4:
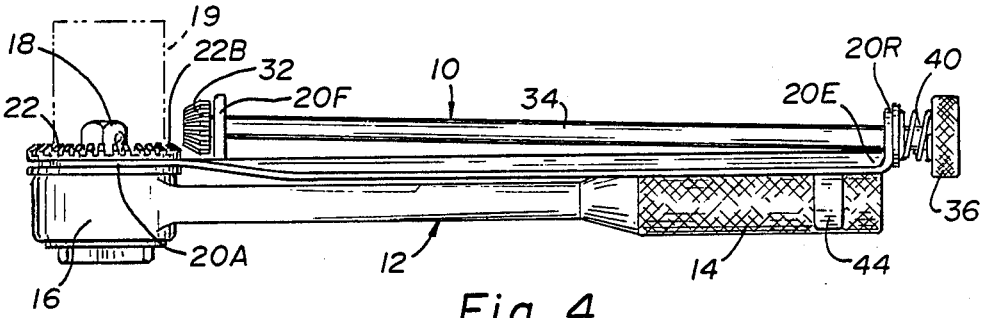
FIG. 4 is a side view of the assembly of FIGS. 1 and 3.

The member 22 has, as is best seen in FIGS. 2 and 5, a flat central portion 22S sized to receive the base of the connected sockets that otherwise could fit on the wheel portion l6W. For example, in the case of a one-half inch wide drive stud, this area could have a diameter of one and one-eighth inches to receive the longest common sockets for that size socket wrench. Of course, if large-sized sockets are desired to be used, the area could be made larger to accommodate them also. A central opening 22D is provided in the flat gear member 22 sized to fit about and to receive the drive stud 18 of the wrench 12, as shown in FIGS. 1, 3, and 4. As is clearest shown in FIG. 4, the member 22 extends slightly beyond the head 16, so it may be hand-turned to start a nut on a socket 19 (when there is sufficient clearance to place a hand in the work area where the nut is to be threaded into a shaft.) The outer periphery of the member 22 is preferably knurled. Outside of the socketreceiving area 22S, the member 22 has gear teeth 22B which also provide a good gripping surface. The gear teeth 22B are formed about the entire periphery of the member 22.

Also mounted on the base 20 is a drive shaft assembly 30 which includes a drive gear 32 which may mesh with the driven bevelled gear 22B for turning the member 22. The drive pinion gear 32 is mounted at and to the head end of shaft 34 which extends substantially the length of the base 20. At the rear or handle end of the shaft 34 is provided means for rotating the shaft and gear 32, namely, a knurled knob 36. The shaft 34 is mounted to the base 20 by being received in a forward upstanding member 20F and a rear member 20R which loosely receives the shaft in round holes so as to allow it to rotate by turning the knob 36 as indicated by the arrows 38.

Figure 8:
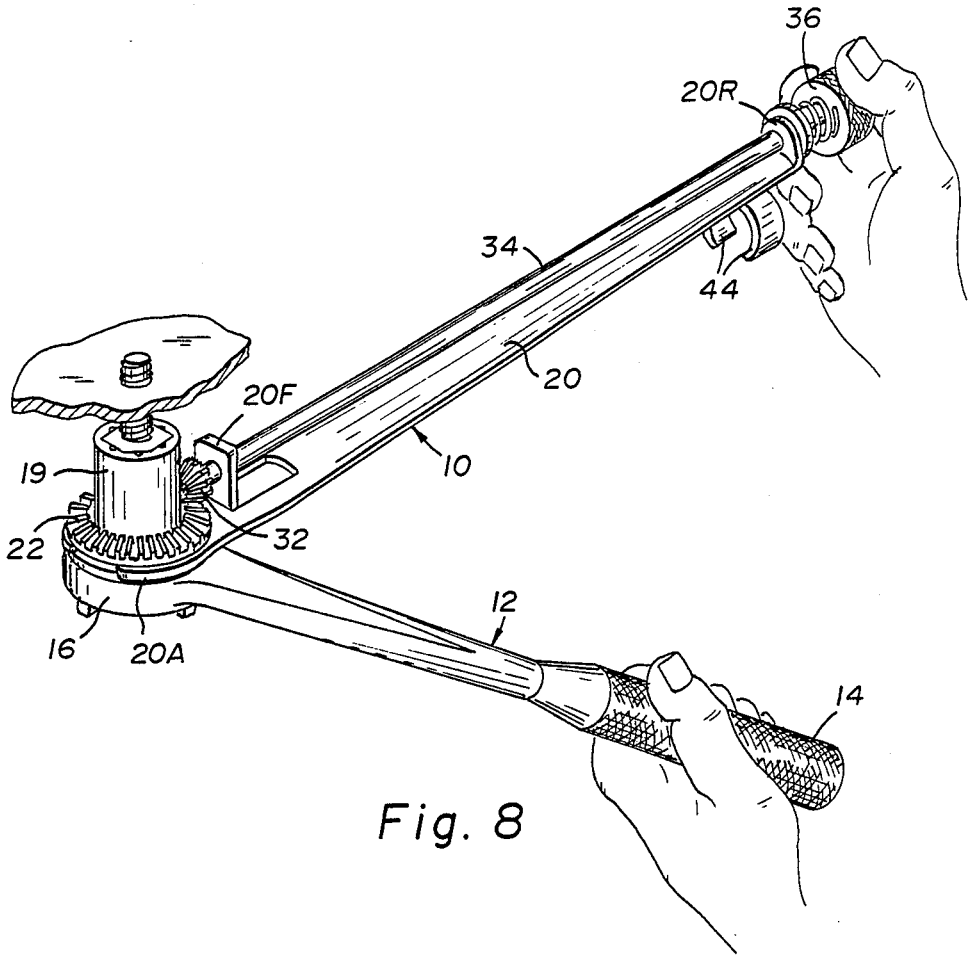
FIG. 8 is a perspective view of the device and wrench of the preceding figures in use with a socket to drive a nut on a threaded shaft, the wrench and device being shown grasped by the hands of a user.

The shaft assembly 34 is also mounted for slidable displacement toward the member 22 (as indicated by the arrow 39). When moved forward to an operational position, the gear 32 may mesh with the gear teeth 22B, as shown in FIG. 8, and drive the stud 18 and socket 19. The support member 20F also serves to define a rearward or home position for the gear 32 and assembly 30. When in this position (as shown, e.g., in FIG. 4), the gear 32 is free of the gear 22B, and the wrench 12 may be used in an entirely conventional manner.

In accordance with one feature of the present invention, the shaft assembly 30 is provided with a spring 40 which mechanically biases the assembly toward the "home" position of FIGS. 1–4. This spring coils about the shaft 34 between the rear standard 20R and the knob 36 and is strong enough to maintain the gear 32 out of engagement even when the shaft is vertical and the gear 32 is pointed down. The shaft 32, knob 36, and gear 32 may be of lightweight material since this assembly does not serve to tighten the socket 19 and any nut received in it against any substantial resistance. The function of the assembly 30 is only to tighten the nut against low resistance and to solve the aforementioned problems of nuts that can't be advanced because they are so loosely threaded that they do not supply enough back pressure to allow the wrench 12 to ratchet.

Figure 7:
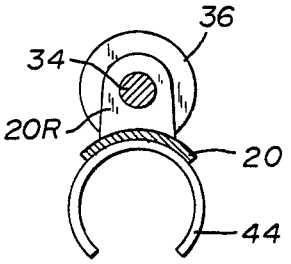
FIG. 7 is a sectional view of the device of FIGS. 1–6 as seen from the plane indicated by the line 7—7 in FIG. 2, when looking in the direction of the associated arrows in that figure.

The device 10 may be used as shown in FIGS. 1, 3, and 4, with the base 20 overlying the handle 14. To this end and also to provide ease of storage, the device 10 is provided with a spring metal or plastic C-clip 44 whose shape is best shown in FIG. 7. As also shown, the base 20 may be formed of thin sheet steel stock, plastic, or carbon resin and curved to conform to the handle 12 and provide greater strength and rigidity.

Although the base 20 may be kept clipped to the handle 14 as shown in FIGS. 1, 3, and 4, and the combined wrench 12 and device 10 used in this configuration, it may also be used as shown in FIG. 8. When used in this manner, the base serves as a second handle which can be positioned at any convenient radial position from the head. The socket may be turned by turning the knob 36 or by pivotably moving the base 20 and assembly 30 (while pressing the knob 36 forward to engage the drive gear 32 and while holding the knob 36 from turning) or by a combination of these or by pivotally moving the wrench 12 or by a combination of all three ways.

The base 20 is made slightly flexible in the area 20H so that the user may pivot up the base 20 to separate the spring clip 44 from the handle without removing the flat gear member 22 from the drive stud 18.

Second Embodiment

Figure 8A:
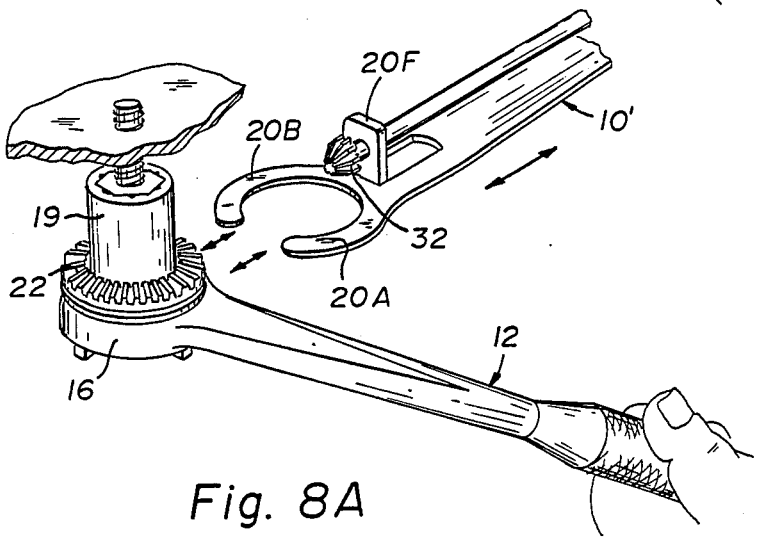
FIG. 8A is a view similar to that of FIG. 8, of an alternative construction of the present invention.

Referring to FIG. 8A, there is depicted a second embodiment 10' of the attachment, wherein the arms 20A and 20B are of spring material and are formed so as to allow them to be released from the member 22 by pulling the second handle body 20 away from the member 22. The arms 20A and 20B can also be returned to the member 22 by placing them into the groove thereof and pressing the handle in place.

This construction allows the use of the member 22 as a hand disc or, if the hand cannot conveniently reach the member 22, to insert the handle 20 into the groove and use it as in FIG. 8.

Third Embodiment

Figure 9:
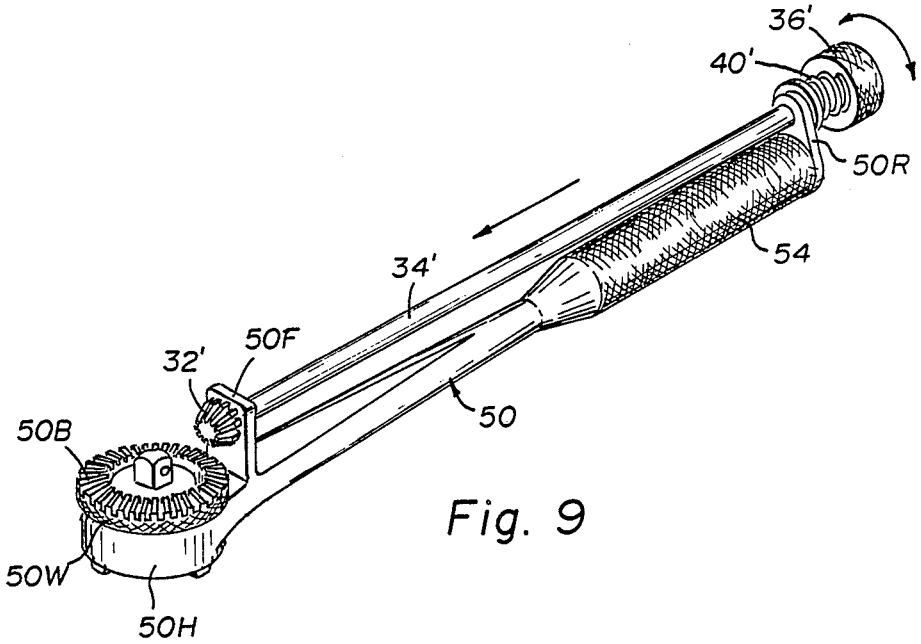
FIG. 9 is a perspective view of a third embodiment of the present invention, a wrench and device combination.
Figure 10:
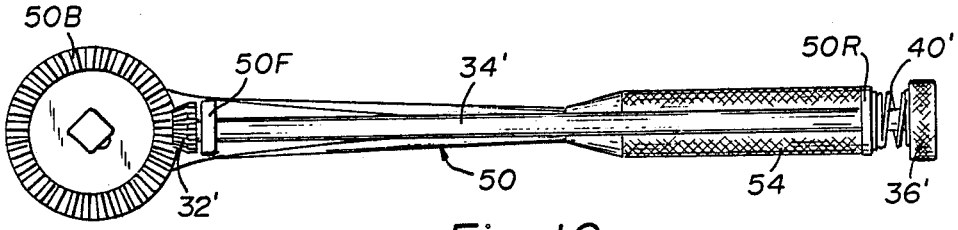
FIG. 10 is a top or plane view of the wrench of FIG. 9.
Figure 11:
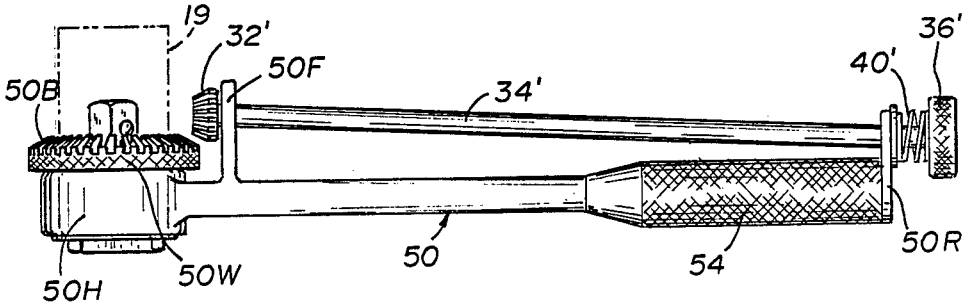
FIG. 11 is a view of the wrench of FIGS. 9 and 10, with a socket shown in dashed outline.

Referring to FIGS. 9–11, there is a third embodiment of the invention, wherein the advancing device is incorporated permanently into a wrench 50. In this case, the driven gear 50B is incorporated into the wheel 50W which projects out from the head 50H of the wrench 50. A sufficiently large diameter area inside the gear teeth 50B is provided to receive conventional sockets 19 (FIG. 11). A shaft 34' is provided as before between a driven gear 32' and a knob 36'. Standards 50F and 50R project from the front and rear of handle 54 of the wrench and serve the same purposes as the standards 20F and 20R of the prior embodiment. A spring 40' is also provided for the same end. Alternatively, the shaft 34 could be incorporated inside of the handle 54, for example, through a bore formed therein.

Operationally, the wrench 50 could be used in substantially the same way as the above-described retrofit device 10 when it was affixed to the handle 14.

The key advantage of the wrench 50 over prior wrenches such as that shown in the aforementioned U. S. Pat. No. 4,406,184 is that the user may easily select the use of the drive gear 32' drive and then automatically go to the conventional pivotal use without the need to do anything more than release the knob 36'. This materially increases the usefulness of the wrench 50 and it saves the user time. The wrench 50 is, functionally, always a conventional socket ratchet wrench and may be so used and without detracting from its conventional use.

It should now be apparent that a novel device has been described and depicted for retrofitting existing standard wrenches with the ability to be turned against low resistance from the second handle, without pivoting the main handle. And a novel wrench contruction has been described which is more efficient in use than prior such wrenches.

While three particular embodiments of the invention have been shown and described, it will be obvious to those skilled in the art that changes and modifications may be made without departing from the invention, and, therefore, the aim in the appended claims is to cover all such changes and modifications as fall within the true spirit and scope of the invention.

Among the modifications which the present invention contemplates as within at least the broader claims would be forming the flat gear 22 of stamped sheet metal with raised gear teeth and depressed tabs. The drive gear, although shown as a bevelled pinion, could also be a conventional flat gear. The gear 22 might also be formed by an extension of the base 20. Also, safety clutch provisions for the gear 32 can be provided. For example, it can be mounted and spring biased downward so as to rise up out of the gear teeth 22B without damaging them when the socket encounters significant resistance in turning a nut.

I claim:

1. A device for retrofitting onto a ratchet wrench of the type that has a platform with projecting drive stud therefrom for receiving sockets of a normal diameter and an elongated handle with a handle-operable loose nut turning ratchet device, comprising:

an elongated base having a drive end and a handle end, a flat gear member mounted on said base for rotation thereon at said drive end and having a central opening sized and shaped to conform and to fit about the drive stud and lie above the platform, said flat gear member having a flat thin portion about said opening, such that a socket of normal diameter can be secured to the drive stud above that portion of the gear, so as to sandwich the portion between the socket and the platform, said flat gear member extending beyond the normal diameter of the socket and including a set of gear teeth surrounding said portion outside of the normal diameter, and a movable drive shaft mounted along said base from the handle end toward said flat gear member and said drive shaft having driven gear means adapted to be manually-actuated from the handle end, to selectively engage and disengage the gear teeth of said flat gear member and to revolve said flat gear member so as to rotate the drive stud of a socket wrench to which said flat gear member may be affixed.

2. The device for retrofitting onto a ratchet wrench as defined in claim 1, wherein it also includes means for releasably securing the handle end of said base to the handle of a socket wrench.

3. The device for retrofitting onto a ratchet wrench as defined in claim 1, wherein it also includes mechanical bias means for returning and keeping said drive gear means to a home position wherein said drive gear means is disengaged from said flat gear member and from which it must be moved by manual operation against such bias to engage said flat gear member.

4. A ratchet wrench, comprising, in combination:

an elongated handle, a head on one end of the handle, a drive stud projecting from the head for insertion into wrench sockets, ratchet drive means coupling said stud and said elongated handle, said wrench including a driven gear connected to said drive stud for turning with it, a slidable shaft extending approximately the length of said handle, which shaft also may be turned, a drive gear at one end of said shaft capable of meshing with said driven gear when moved forward, said shaft being slidable from a forward position in which the drive gear may engage the driven gear for turning it, to a home position wherein the drive gear is free of the driven gear and mechanical bias means for uging and holding the shaft toward said home position and away from said driven gear, said mechanical bias means being of such a strength as to allow a user to overcome it when desired by manually pushing the shaft forward, against such mechanical bias, so as to engage said driven gear and to turn said drive stud by also rotating said turning means, and yet of sufficient strength to return and keep said shaft and drive gear in the home position when not manually displaced by the user.

5. In a socket ratchet wrench of the type having a drive head with a projecting drive stud for receiving sockets and a main handle, the improvement of:

a second handle member and means for mounting said second handle member to the drive head and is positionable therefrom at any selected radial position therefrom over a range different from the radial position of the main handle, said selected radial positions including oppositely positioning said second handle to the main handle, including second means mounted to said second handle member for selectively engaging and disengaging the drive stud of said head so as to selectively at least hold it stationary.

6. The socket ratch wrench improvement of claim 5, wherein:

said means for selectively engaging the drive stud includes a set of gear teeth coupled to it and a drive gear which is selectively movable into or out of engagement with said set of gear teeth, and said means further includes means for movably rotating said drive gear from said second handle, whereby the drive stud may be selectively held stationary by engaging the drive gear with said gear teeth and handle member or turned by engaging the drive gear and movably rotating it, all from the second handle member.

7. In a socket ratchet wrench of the type having a drive head with a projecting drive stud for receiving sockets and a main handle, the improvement of:

a second handle member and means for mounting said second handle member to the drive head such that it extends from the drive head and is positionable therefrom at any selected radial position therefrom over as range different from the radial position of the main handle, said selected radial positions including oppositely positioning said second handle to the main handle, including second means mounted to said second handle member for selectively engaging and disengaging the drive stud of said head so as to selectively at least hold it stationary;

said means for selectively engaging the drive stud includes a set of gear teeth coupled to it and a drive gear which is selectively movable into or out of engagement with said set of gear teeth, and said means further includes means for movably rotating said drive gear from said second handle, whereby the drive stud may be selectively held stationary by engaging the drive gear with said gear teeth and handle member or turned by engaging the drive gear and movably rotating it, all from the second handle member; and wherein:

said drive gear is mounted on one end of a shaft which extends approximately the length of the second handle member, and said shaft is mounted for both rotation and slidable displacement from a home position in which the drive gear does not engage said gear teeth and an operational position in which it does engasge said gear teeth.

8. The socket wrench improvement as defined in claim 7, wherein it also includes mechanical bias means for returning and keeping said drive gear to a home position wherein said drive gear is disengaged from said set of gear teeth and from which it must be moved by manual operation against such bias to engage said set of gear teeth.

9. The socket ratchet wrench improvement of claim 8, wherein said shaft has a knob mounted at the other end of said shaft.

10. The socket wrench improvement of claim 7, wherein means are provided for releasably detenting said second handle to said set of gear teeth so said second handle and drive gear and its shaft may be selectively manually attached to and released from said set of gear teeth coupled to the drive stud, and can be easily removed therefrom when desired by a simple pull on the second handle.

* * * * *

UNITED STATES PATENT OFFICE

CERTIFICATE OF CORRECTION

PATENT NO. : 4,762,031

DATED : Aug. 9, 1988

INVENTOR(S) : Ross Bradley

It is certified that error appears in the above-identified patent and that said Letters Patent are hereby corrected as shown below:

Col. 3, Line 36, delete "socketreceiving" and substitute --socket-receiving--

Col. 6, Line 28, delete "uging" and substitute --urging--

Col. 6, Line 43, add after "second handle member to the drive head", --such that it extends from the drive head--

Col. 7, Line 5, delete "as" and substitute --a--

Col. 8, Line 5, delete "engasge" and substitute --engage--

Signed and Sealed this

Fourteenth Day of February, 1989

*Attest:*

DONALD J. QUIGG

*Attesting Officer*

*Commissioner of Patents and Trademarks*